US005349801A

United States Patent [19]

Verbofsky

[11] Patent Number: 5,349,801

[45] Date of Patent: Sep. 27, 1994

[54] SHEET METAL SHINGLE

[75] Inventor: David W. Verbofsky, Sidney, Ohio

[73] Assignee: Aluminum Company of America, Pittsburgh, Pa.

[21] Appl. No.: 111,662

[22] Filed: Aug. 25, 1993

[51] Int. Cl.[5] ..... E04D 1/16; E04D 1/36

[52] U.S. Cl. ..... 52/518; 52/478; 52/545

[58] Field of Search ..... 52/518, 519, 478, 538, 52/545

[56] References Cited

U.S. PATENT DOCUMENTS

| | | | |
|---|---|---|---|
| 1,519,350 | 12/1924 | Belding . | |
| 3,394,515 | 7/1968 | Widdowson | 52/536 |
| 4,184,301 | 1/1980 | Anderson et al. | 52/478 |
| 4,185,436 | 1/1980 | Vallee | 52/519 |
| 4,223,503 | 9/1980 | Hague | 52/478 |
| 4,316,351 | 2/1982 | Ting | 52/309.9 |
| 4,700,520 | 10/1987 | Ting | 52/478 |
| 4,759,165 | 7/1988 | Getoor et al. | 52/520 |

*Primary Examiner*—James L. Ridgill, Jr.
*Attorney, Agent, or Firm*—David W. Brownlee

[57] ABSTRACT

A sheet metal shingle for horizontal application on a roof beginning at the roof ridge and proceeding downwardly. The shingle has a male portion along its top edge, a female portion adjacent its lower edge and hook portions along both vertical ends. A bead of resilient compressible material is disposed along the male edge of the shingle, and a bead of sealing material is disposed in at least one of the hook portion.

9 Claims, 2 Drawing Sheets

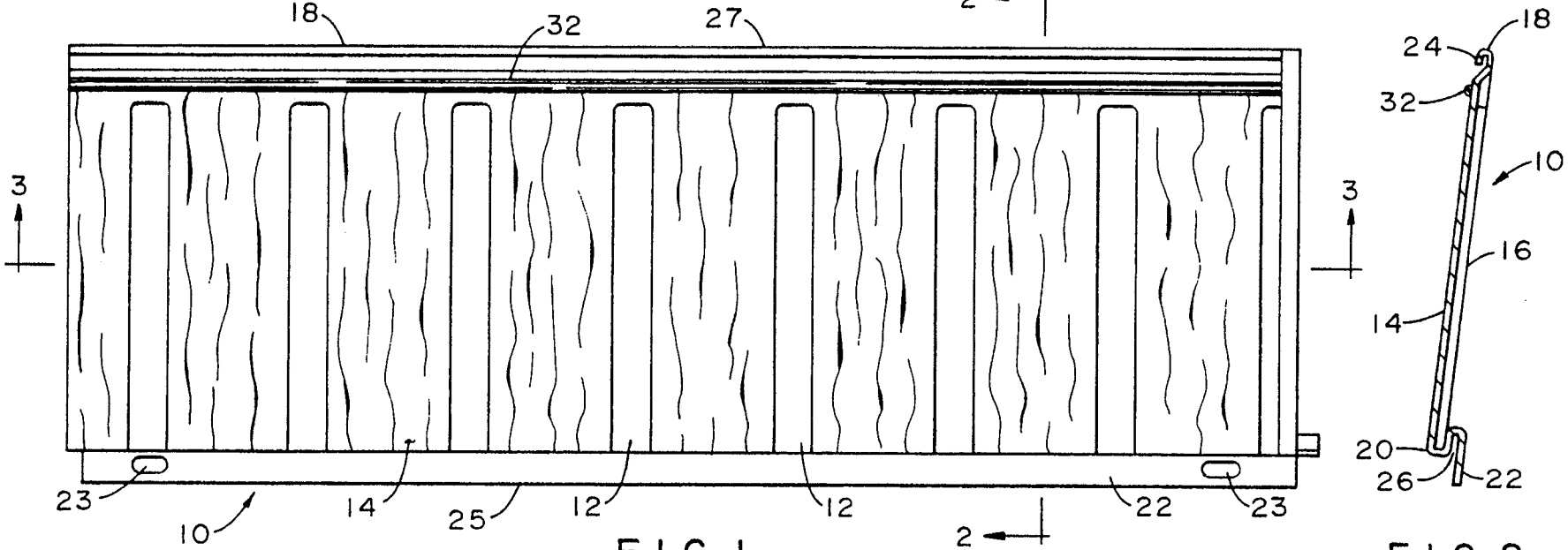
FIG. 2
FIG. 1
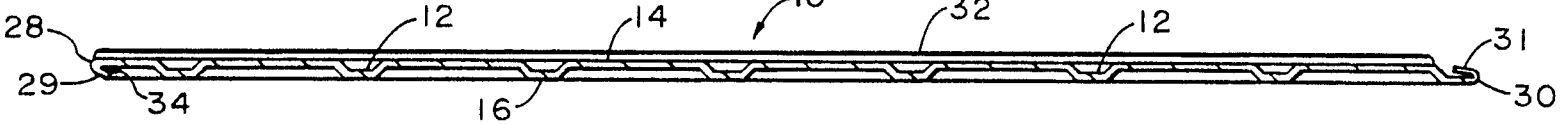
FIG. 3

SHEET METAL SHINGLE

This invention relates to sheet metal shingles, and in particular to sheet metal shingles which are adapted to be applied beginning at a roof ridge and proceeding downwardly, and which has sealing beads of foamed urethane and caulking compound for minimizing water penetration through a shingled roof.

BACKGROUND OF THE INVENTION

Water leakage through man made metal shingles has been a problem for many years. The problem is particularly troublesome for shingles which are adapted to be installed from top down beginning at a roof ridge. The problem is most severe for roofs having relatively low slopes of 4–12 (4" in 12") or less from which water does not drain quickly. Water penetration through installed metal shingles can occur by capillary action which is difficult to prevent.

U.S. Pat. No. 1,519,350 discloses a sheet metal shingle which is adapted to be installed beginning at a roof ridge and proceeding downwardly. The shingle has a male portion along its top edge, a female portion adjacent its bottom edge, and an attachment or nailing flange below the female portion. The shingle also has open folded flanges on opposite sides which are interengaged when the shingle is installed on a roof.

U.S. Pat. No. 4,759,165 discloses a roofing panel having side edges formed by a curved transition portion and a return bend flange. A bead of resilient sealant material is adhered within the curved transition portion to provide a seal with respect to the adjacent panel. U.S. Pat. No. 3,394,515 shows a deformable gasket in a channel along a side edge of a roofing panel. The gasket forms a seal with an interlocking edge of an adjacent panel. Other uses of beads of sealant materials in roofing panels are disclosed in U.S. Pat. No. 4,316,351; 4,184,301 and 4,223,503.

There is a need for a sheet metal shingle that is adapted to be installed on a roof beginning at a roof ridge and proceeding downwardly, and which resists water penetration through the shingles to the underlayment. Such a shingle is especially desired for application on roofs with relatively low slopes.

SUMMARY OF THE INVENTION

The present invention is directed to a sheet metal shingle for application on a roof beginning at a ridge and proceeding downwardly, and which has resilient sealing material for sealing against adjacent shingles wound the entire perimeter of the shingle. The shingle has a male portion along one edge thereof which will be the upper edge when installed on a roof, and has a female portion adjacent the opposite edge. A bead of resiliently compressible material such as nitrogen foamed urethane or nitrogen foamed silicon is adhered to the male edge of the shingle for sealing against the inside of the female portion on the adjacent shingle. The shingle has a nailing flange below the female portion of the shingle. The shingle further has an inwardly turned hook along one end (vertical edge when installed) and an outwardly turned hook along the other end for interengagement or interlocking of vertical edges of adjacent shingles. A non-hardening sealant material such as butyl caulking compound is disposed in one or both of the turned flanges to provide a seal between the vertical edges of adjacent shingles.

Shingles of this invention ware adapted to effectively resist water penetration when installed on roofs having relatively low slopes. The water seal provided by this invention is superior to the prior art shingles. Other objects and advantages of this invention will be more fully understood and appreciated with reference to the following description and the drawings.

BRIEF DESCRIPTION OF THE DRAWINGS

FIG. 1 is a top plan view of a shingle of this invention.

FIG. 2 is a cross-sectional view of the shingle of FIG. 1 taken along line 2—2.

FIG. 3 is a cross-sectional view of the shingle of FIG. 1 taken along line 3—3.

DESCRIPTION OF A PREFERRED EMBODIMENT

Figure 4:
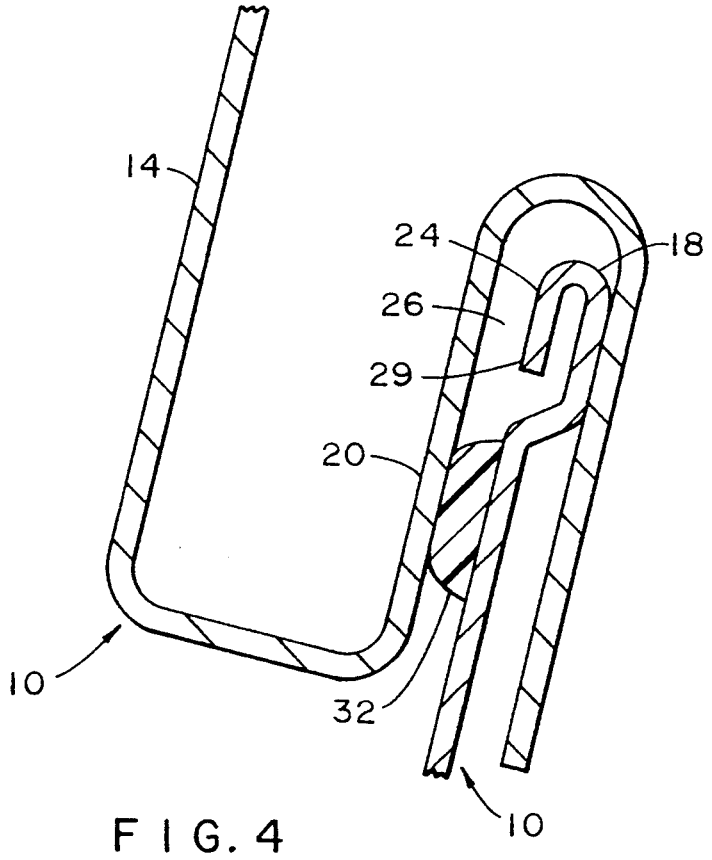
FIG. 4 is an enlarged fragmentary cross-sectional view showing the interlock between the top and bottom edges of two adjacent shingles of this invention.

Referring to FIGS. 1–3 of the drawings, a sheet metal shingle 10 of the invention is shown which comprises a rectangular panel preferably made from sheet aluminum alloy or galvanized sheet. The shingle 10 is adapted to be applied to a roof in a horizontal fashion across the roof so that the major axis of the shingle extends horizontally on the roof. The shingle 10 may have a multiplicity of recessed channels 12 formed therein which extend transversely of the major axis of the shingle so the channels will be aligned with the slope of the roof. The shingle may also have a simulate wood grain formed in it for aesthetic purposes. Shingles of this invention are especially adapted to be installed from top-down beginning at a roof ridge. Shingle 10 has an outer surface 14 which will be exposed upwardly and outwardly when the shingle is applied to a roof structure and an inner surface 16 which will be disposed against the roof underlayment when the shingle is applied to a roof structure.

The shingle 10 has a male edge 18 which is intended to be installed as the top edge of the shingle and a female portion 20 which is adjacent the lower edge 25 of the shingle. A nailing flange 22 is disposed along the lower edge 25 of the shingle below the female portion 20. The nailing flange may have holes 23 in it which are solely for use during manufacture of the panel to receive pins for moving the panel during the manufacturing process. The holes 23 are not nailing holes. The male edge 18 preferably includes a doubled over return bend portion 24 to strengthen the shingle and shield the cut upper edge 27 of the panel from which the shingle is formed.

The female portion 20 is in the form of an S-bend in the panel (FIG. 2). The S-bend includes a downwardly open channel 26 for receiving the male portion 18 of the adjacent shingle as seen in FIG. 4. The channel 26 extends for the full length of the shingle 10 and is sized to receive the male portion 18 in snug engagement therewith.

Figure 5:
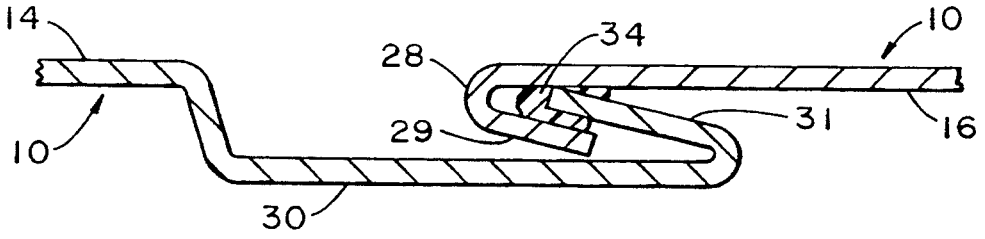
FIG. 5 is an enlarged fragmentary cross-sectional view showing the interlock between the vertical edges of two adjacent shingles of this invention.

The vertical edges 28, 30 of shingle 10 have hook portions 29, 31 thereon for engagement with similar hook portions of contiguous shingles when installed on a roof (FIG. 5). The hook portions 29, 31 are in the form by reversely turned flanges on the ends of the shingle. One hook portion 29 on the left end of the shingle is turned inwardly toward the inwardly facing surface 16 of the shingle, and the hook portion 31 on the right end of the shingle is turned outwardly toward the outwardly exposed surface 14 of the shingle.

In accordance with this invention, shingle 10 has a bead of resilient compressible material 32 disposed on either the male edge 18 or in the channel 26 along the full length of the shingle. In a preferred embodiment the bead of material 32 is preferably on the male end 18 as shown in the drawings. The resilient material 32 is adapted to be compressed by, and to seal against, the interior surface of the channel 26 when the male edge 18 is inserted into the channel 26 of the adjacent shingle as seen in FIG. 4. The resilient compressible material may be nitrogen foamed urethane which is laid down as a semicircular bead having a diameter of approximately $\frac{1}{8}$ inch. A smaller or larger bead could be used depending on the nature of the material and its manner of application among other things. It is important to form a good bond of the material 32 to the surface of the shingle 10 so the material will not separate from the shingle during handling or when the male edge 18 is inserted into the channel 26. In the manufacture of shingles 10 in accordance with this invention, nitrogen, air, or other suitable gas is preferably mixed with urethane which is then deposited along the top edge of the shingle to form the compressible bead 32 bonded to the shingle.

This invention further requires that a bead of non-hardening sealing compound 34 be disposed in, and along the full length of, at least one of the hook portions 29, 31 on the shingle. The sealing material 34 may be a polymeric or butyl robber type material such as the caulking compounds used for sealing cracks of other openings in residential or commercial buildings. The sealing compound is preferably disposed in the hook portion 31 on the right end of the shingle. Hook portion 31 faces upwardly during the forming process and is not closed tightly. This provides sufficient opening for depositing the compound 34 in the hook. The hook 31 can be closed further after the compound has been disposed in it, if desired.

In the installation of shingles 10 of this invention, a metal drip edge member is applied to the gables of the roof, as is well known in the art, first before the shingles are applied to the roof. The first course of shingles 10 is applied to the roof beginning at the ridge and proceeding downwardly from it. The edge portions of the shingles at the gable ends (both ends of the roof) are given a doubly downward bend in the field to form a u-shaped end portion on such edge portion to enclose and fit under the drip edge at the gable at both ends of the roof for each course of shingles. This avoids any need for a separate end cap at the gables.

A flashing or coping is applied on the roof ridge over the shingles to seal the ridge much like is done with asphalt shingles and a finish cap is applied over the flashing or coping. As each subsequent course of shingles is laid, the sealing material 32 on male edge 18 of the lower course seals against the inside of the channel 26 of the female portion of the contiguous shingle thereabove. The sealing compound on the hook portions 29 and 31 seals the laterally contiguous shingles against water penetration through the installed shingles.

Shingles of this invention, as described above, have the important advantage of being suitable for applications on roofs with very low slopes such as a 2–12 slope. The shingles provide an effective seal against water penetration when installed on such low sloped roofs. The seal is effective even against capillary penetration of water.

Whereas a preferred embodiment of the invention has been described for purposes of illustration, it will be evident to those skilled in the art that numerous variations of details may be made without departing from the inventions as defined in the appended claims.

What is claimed is:

1. A sheet metal shingle adapted to be installed on a roof beginning at a roof ridge and proceeding downwardly, said shingle having a first surface to be exposed outwardly, a second surface to face inwardly, a first longitudinally extending edge to be installed as a top edge of the shingle and a second longitudinally extending edge to be installed as a bottom edge of the shingle, said shingle comprising an elongated generally rectangular metal panel shaped to have ornamental contours therein extending generally transversely of the panel, a male portion extending along said first edge, a female portion extending adjacent said second edge to receive a male portion of an adjacent shingle, an integral nailing flange extending along said second edge below said female portion, first and second hook portions extending along first and second ends of said panel with a first hook portion turned outwardly toward said first surface and a second hook portion turned inwardly toward said second surface so that hook portions on adjacent shingles can be interengaged, a bead of resilient, compressible foamed polymeric material adhered to said male portion of said panel along the length of the panel to resist moisture infiltration through the engagement of male and female portions of adjacent shingles and a sealing compound disposed in at least one of said hooks along the length thereof to resist moisture infiltration through interengaged hooks on adjacent shingles.

2. A shingle as set forth in claim 1 in which said polymeric material is nitrogen foamed urethane.

3. A shingle as set forth in claim 1 in which said polymeric material is adhered to the outwardly facing surface of said male member.

4. A sheet metal shingle adapted to be installed horizontally on a roof beginning at a roof ridge and proceeding downwardly, said shingle having a first surface to be exposed outwardly, a second surface to face inwardly, a first longitudinal edge to be installed as the top edge of the shingle and a second longitudinal edge to be installed as the bottom edge of the shingle, said shingle comprising an elongated rectangular metal panel shaped to have ornamental contours therein extending generally transversely the panel, a male portion extending along said first edge, a female portion extending adjacent said second edge to receive a male portion of an adjacent shingle, an integral nailing flange extending along said second edge below said female portion, hook portions extending along both ends of said panel with one hook portion turned inwardly toward said second surface so that hook portions on adjacent shingles can be interengaged, a bead of resilient, compressible foamed polymeric material adhered to at least one of said male portion and said female portion along the length of the panel to resist moisture infiltration through the engagement of male and female portions of adjacent shingles.

5. A shingle as set forth in claim 4 in which said polymeric material is nitrogen foamed urethane.

6. A shingle as set forth in claim 4 in which said polymeric material is adhered to the outwardly facing surface of said male member.

7. A shingle as set forth in claim 4 which has a plurality of recessed channels therein extending between said male and female portions.

8. A shingle as set forth in claim 4 which further includes sealing compound disposed in said outwardly turned hook along the length thereof for sealing of said outwardly turned hook with the inwardly turned hook of the adjacent shingle.

9. A sheet metal shingle made of an aluminum alloy adapted to be installed on a roof beginning at a roof ridge and proceeding downwardly, said shingle having a first surface to be exposed outwardly, a second surface to face inwardly, a first longitudinally extending edge to be installed as the top edge of the shingle and a second longitudinal extending edge to be installed as the bottom edge of the shingle, said shingle comprising an elongated rectangular metal panel shaped to have ornamental contours therein extending generally transversely the panel, a male portion extending along said first edge, a female portion extending adjacent said second edge to receive a male portion of an adjacent shingle, an integral nailing flange extending along said second edge below said female portion, hook portions extending along both ends of said panel with one hook portion turned outwardly toward said first surface and the other hook turned inwardly toward said second surface so that hook portions on adjacent shingles can be interengaged, a bead of resilient, compressible nitrogen foamed urethane material adhered to the outwardly facing surface of said male portion of said panel along the length of the panel to resist moisture infiltration through the engagement of male and female portions of adjacent shingles and a sealing compound disposed in at least one of said hooks along the length thereof to resist moisture infiltration through interengaged hooks on adjacent shingles.

* * * * *